US005189335A

United States Patent [19]

Sekihara et al.

[11] Patent Number: 5,189,335

[45] Date of Patent: Feb. 23, 1993

[54] METHOD OF CONTROLLING ELECTRON BEAMS IN AN IMAGE DISPLAY APPARATUS

[75] Inventors: Toshinobu Sekihara, Osaka; Mitsunori Yokomakura, Takatsuki, both of Japan

[73] Assignee: Matsushita Electric Industrial Co., Ltd., Osaka, Japan

[21] Appl. No.: 813,489

[22] Filed: Dec. 23, 1991

Related U.S. Application Data

[62] Division of Ser. No. 600,806, Oct. 22, 1990, abandoned.

[30] Foreign Application Priority Data

Oct. 20, 1989 [JP] Japan ..... 1-274098

[51] Int. Cl.[5] ..... H01J 29/70; H01J 29/74

[52] U.S. Cl. ..... 313/422; 313/495

[58] Field of Search ..... 313/422, 495

[56] References Cited

U.S. PATENT DOCUMENTS 4,955,681 9/1990 Sekihara et al. ..... 313/422 X 4,980,613 12/1990 Miyama et al. ..... 313/422 X

*Primary Examiner*—Sandra L. O'Shea

*Attorney, Agent, or Firm*—Wenderoth, Lind & Ponack

[57] ABSTRACT

An image display apparatus includes a plurality of line cathodes arranged horizontally in parallel with each other; an electron beam leading electrode device allowing a plurality of electron beams radiated from the line cathodes to pass therethrough; a signal electrode device for controlling quantity of the electron beams passing therethrough according to a video signal; a focusing electrode device for focusing the electron beams; a horizontal deflecting eletrode device for electrostatically deflecting the electron beams horizontally; a vertical deflecting electrode device, for electrostatically deflcting the electron beams vertically, comprising of a pair of comblike conductive plates each having vertical teeth spaced to intervals, opposed to each other, and alternating with each other in the same plane, electron beams which pass through the vertical deflecting electrode device crossing over in a vertical section thereof and being focused; and a display device which emits a light as a result of a collison of electron beams.

1 Claim, 2 Drawing Sheets

METHOD OF CONTROLLING ELECTRON BEAMS IN AN IMAGE DISPLAY APPARATUS

This application is a division of now abandoned application Ser. No. 07/600,806 filed on Oct. 22, 1990, now abandoned.

BACKGROUND OF THE INVENTION

1. Field of the Invention

The present invention relates to a method of controlling electron beams in an image display apparatus for use in a video equipment.

2. Description of the Related Art

Conventionally, a cathode-ray tube is mainly used as the image display element of a color television, however, the cathode-ray tube is much greater than the screen in depth. Therefore, it is impossible to manufacture a thin television receiver. In order to manufacture a thin television receiver, display elements such as an EL display element, a plasma display element, and a liquid crystal display element have been developed. But none of them are preferable in luminance, contrast, and a color reproducibility.

In order to solve the above-described problem, the following image display apparatus of a color television has been developed. The image plane thereof is divided into a plurality of sections of a matrix configuration so that a thin and flat device displays an image utilizing electron beams which form an image equal to that of the cathode-ray tube in quality. Each section is scanned by deflected electron beams so that a fluorescent substance emits a light.

The above-described conventional image display apparatus is described in detail with reference to the drawings.

Referring to FIG. 2 showing the inner construction of the image display apparatus, it comprises a backplate 1; a line cathode 2 serving as an electron beam source; a leading electrode 3; a signal electrode 4; a focusing electrode 5; horizontal deflecting electrodes 6*a* and 6*b*; vertical deflecting electrodes 7*a* and 7*b*; and vacuum glass containers 8*a* and 8*b* accommodating the above components.

Describing the outline of this apparatus, a plurality of rows of electron beams generated by the line cathode 2 are horizontally sequentially introduced through the through-holes of the leading electrode 3. The electron beams are sequentially controlled by the signal electrode 4 according to a video signal. Then, the electron beams are electrostatically focused by the focusing electrode 5, and then, electrostatically deflected horizontally by the horizontal deflecting electrodes 6*a* and 6*b* and vertically by the vertical deflecting electrodes 7*a* and 7*b*. A section 11 of a screen 10 is scanned by one electron beam 9. All sections 11 are connected to each other without any gap therebetween to form an entire image on the screen 10. These electrodes consist of a thin conductive plate and can be laminated with each other.

Therefore, compared with a cathode-ray tube, a thin image display apparatus can be manufactured.

However, in the above conventional image display apparatus, the diameters of electron beams composing a small image plane of a matrix configuration are different from each other in the vertical sections thereof. Thus, the difference in spot diameters does not ensure the uniformity of the image formed on the screen 10. This phenomenon is described with reference to FIG. 3 which is a vertical sectional view showing one electron beam generated by one of the line cathodes 2 of the conventional image display apparatus shown in FIG. 2. The electron beam is electrostatically deflected by the potential difference between the vertical deflecting electrodes 7*a* and 7*b* to form trajectories 20 and 21, thus reaching the screen 10. As a result, beam spots 22 and 23 are formed on the screen 10. But when the electron beam is electrostatically deflected, deflection errors (coma) occur because the diameter (d) thereof is great when it passes through the vertical deflecting electrodes 7*a* and 7*b*. As a result, compared with the beam spot 22 formed when a deflection amount is small in the vertical direction, the beam spot 23 formed when a deflection error (coma) is great in the vertical direction is not focused. Therefore, the beam spot 23 is vertically elongated or trailed upward. Spots in different configurations appear in succession horizontally on the screen 10. Therefore, when an entire image is viewed, long and narrow non-uniformities having different luminances are observed, thus damaging the uniformity of the image.

SUMMARY OF THE INVENTION

It is therefore the object of present invention to provide a method of controlling electron beams in an image display apparatus which forms spots of a uniform diameter in the vertical direction and an image of a high quality.

In accomplishing this and other objects, according to one aspect of the present invention, there is provided a method for controlling electron beams in an image display apparatus, the apparatus comprising: a plurality of line cathodes arranged horizontally in parallel with each other; an electron beam-leading electron; a signal electrode for controlling the quantity of the electron beams passing therethrough; a focusing electrode; a horizontal deflecting electrode; a vertical deflecting electrode has a display means; the vertical deflecting electrode including a pair of comblike conductive plates each having vertical teeth spaced at intervals, opposed to each other, and alternating with each other in the same plane; the method comprising the steps of:

radiating the plural electron beams from the line cathodes so as to pass through the electrode beam leading electrode;

controlling the quantity of the electron beams passing through the signal electrode according to the video signal;

focusing the electron beams with the focusing electrode;

electrostatically deflecting the electron beams horizontally with the horizontal deflecting electrode;

applying a voltage to the vertical deflecting electrode to electrostatically deflect the electron beams vertically, and to focus the electron beams between the plates by the plates to form a spot-shaped beam between the plates; and emitting light with the display means as a result of the collision of the electron beams.

By the above construction of the aspect of the present invention, electron beams cross over when they pass through a vertical deflecting electrode. Therefore, the spot configurations of electron beams can be uniformly formed.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
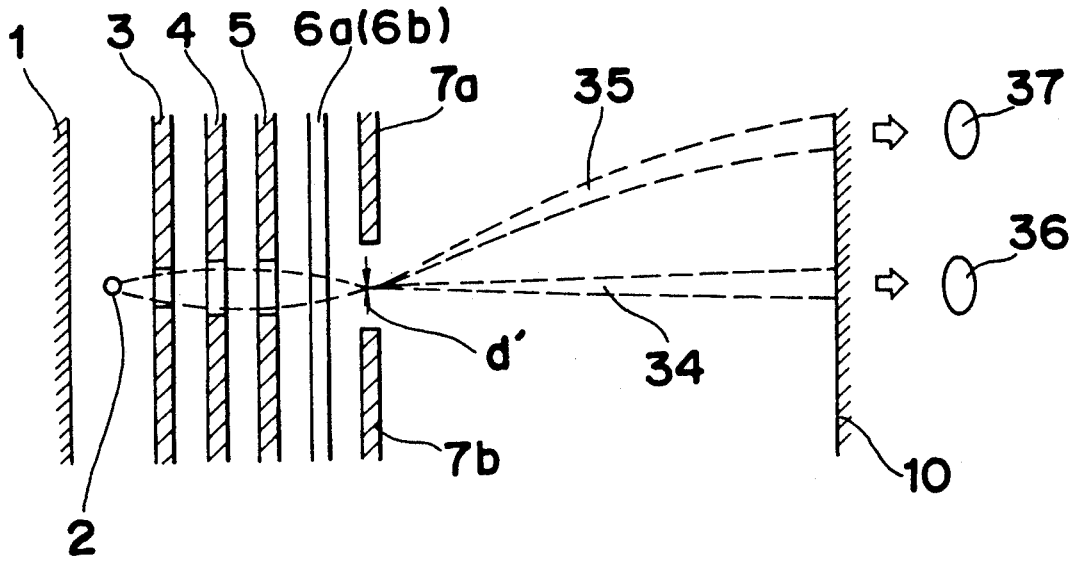
FIG. 1 is a vertical sectional view showing the trajectory of an electron beam radiated by an image display apparatus according to one embodiment of the present invention.

Before the description of the present invention proceeds, it is to be noted that like parts are designated by like reference numerals throughout the accompanying drawings.

A method of controlling electronic beams is an image display apparatus according to an embodiment of the present invention is described with reference to the drawings.

Figure 2:
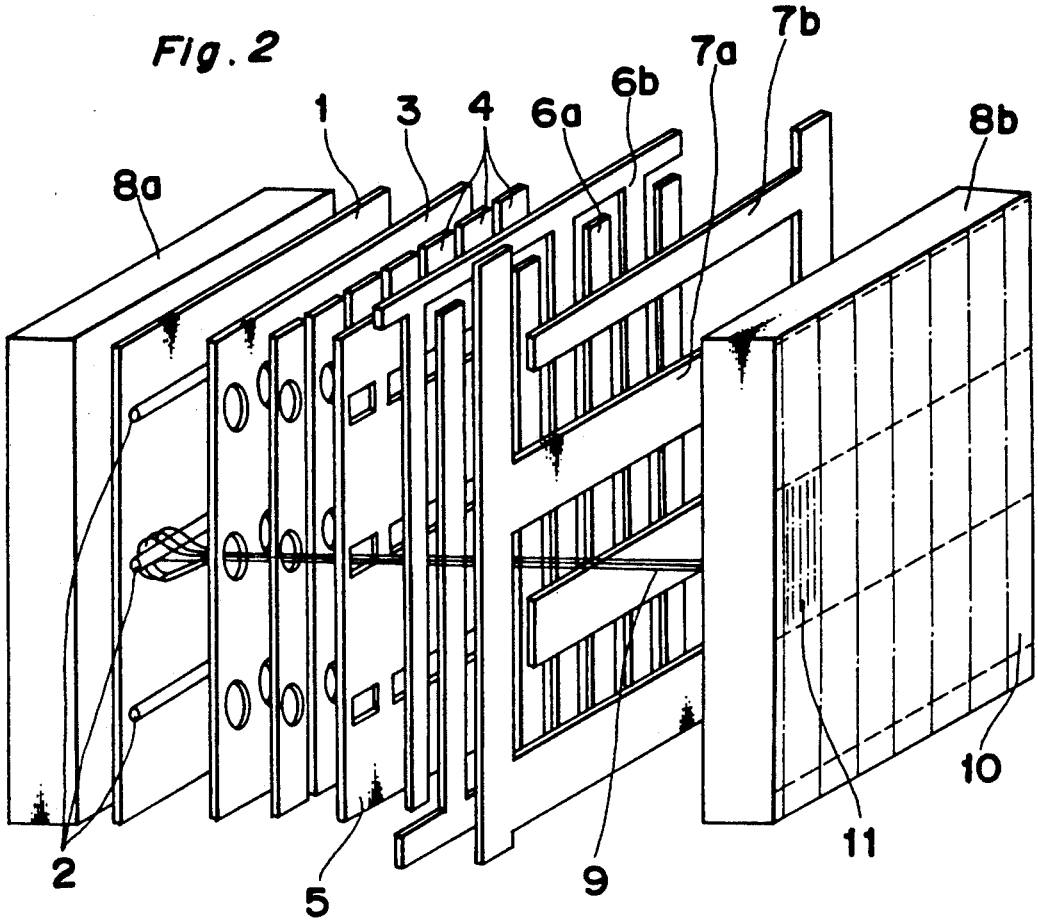
FIG. 2 is a perspective view showing the inner structure of a conventional image display apparatus.

The inner structure of the image display apparatus of the embodiment is similar to that of the conventional one shown in FIG. 2. Therefore, the components of the apparatus are referred to "Description of the Related Art" previously described.

The structure of the apparatus is described with reference to FIG. 2. The line cathodes 2 extend horizontally so that each of them generates an electron flow having a current density distribution approximately uniform in the horizontal direction. The line cathodes 2 are arranged vertically with a certain space provided therebetween (only three line cathodes 2 are shown in this embodiment). The line cathode 2 is made of a tungsten coated with a cathode material consisting of an oxide.

The backplate 1 consists a flat conductive material and is parallel with the line cathodes 2.

The leading electrode 3 is opposed to the backplate 1 with the line cathodes 2 interposed therebetween. The leading electrode 3 consists of a conductive plate having a plurality of rows of through-holes spaced regular intervals from each other horizontally, each row being opposed to each line cathode 2. Each of the through-holes is circular in the embodiment, but may be either elliptic or rectangular or slit-shaped.

The signal electrode 4 consists of a plurality of long conductive plates arranged vertically, spaced at regular intervals from each other, and horizontally opposed to each of the through-holes of the leading electrode 3. Each conductive plate has through-holes similar and opposed to those of the leading electrode 3. Each of the throughholes is circular in the embodiment, but may be either elliptic or rectangular or vertically slit-shaped.

The focusing electrode 5 consists of a conductive plate having through-holes each of which is formed to be horizontally opposed to each through-hole of the signal electrode 4. Each of the through-holes may be either circular or elliptic or slit-shaped. The number of the focusing electrodes 5 may be plural.

As shown in FIG. 2, each of the horizontal deflecting electrodes 6*a* and 6*b* consists of a comblike conductive plates each having teeth vertically formed. The teeth are spaced at regular intervals. The teeth of the electrodes 6*a* and 6*b* alternate with each other in the same plane. Conductive plates adjacent to each electron beam 9 compose a pair of horizontal deflecting electrodes.

Each of the vertical deflecting electrodes 7*a* and 7*b* consists of a comblike conductive plates each having teeth horizontally formed. The teeth are spaced at regular intervals. The teeth of the electrodes 7*a* and 7*b* alternate with each other in the same plane. Conductive plates adjacent to each electron beam 9 compose a pair of vertical deflecting electrodes.

A screen 10 comprises a fluorescent substance applied to the inner surface of the glass container 8*b* and a metal back layer (not shown) laminated thereon. The fluorescent substance emits a light when it is irradiated by an electron beam.

The operation of the image display apparatus having the above structure is described below.

First, a voltage $V_1$ and a voltage $V_2$ higher than the voltage $V_1$ are applied to the backplate 1 and the leading electrode 3, respectively. Then, an appropriate voltage $V_0$ greater than $V_1$ and smaller than $V_2$ is applied to the line cathode 2 while the line cathode 2 is heated to facilitate an electron discharge therefrom. As a result, the electric field of the surface of the line cathode 2 becomes positive. Therefore, electrons are discharged from the line cathode 2 and accelerated toward the leading electrode 3. When the voltage $V_0$ greater than the voltage $V_2$ is applied to the line cathode 2, the electric field of the surface of the line cathode 2 becomes negative. As a result, the discharge of an electron can be suppressed. That is, different voltages are repeatedly applied to the line cathode 2 so that the cathode 2 sequentially radiates electron beams in the order from its upper line to its lower line each for a certain period of time. In this manner, each line of the cathode 2 generates a sheet-shaped electron beam having a uniform current density distribution in the horizontal direction.

The sheet-shaped electron beam is horizontally divided into a plurality of beams by the through-holes of the leading electrode 3. Then, numerous electron beams reach the through-holes of the signal electrode 4. At this time, a voltage $V_3$ greater than the voltage $V_0$ is applied to the signal electrode 4. As a result, the electron beams pass through the through-holes of the signal electrode 4. On the other hand, when the voltage $V_3$ smaller than the voltage $V_0$ is applied to the signal electrode 4, the electron beams lose kinetic energy. Consequently, the electron beams are incapable of passing therethrough. Thus, the passage amount of each electron beam is adjusted according to a video signal for displaying a pixel by sequentially controlling the voltage $V_3$.

The electron beams which have passed through the signal electrode 4 reach the focusing electrode 5. When they pass through the through-holes of the focusing electrode 5, they are focused and shaped by the effect of the electrostatic lens of the through-holes. Then, they are horizontally electrostatically deflected by the potential difference (deflecting voltage) applied to each gap between adjacent conductive plates of the horizontal deflecting electrodes 6*a* and 6*b*. Also, they are vertically electrostatically deflected by the potential difference (deflecting voltage) applied to each gap between adjacent conductive plates of the vertical deflecting electrodes 7*a* and 7*b*. A high voltage, for example, 10 KV is applied to the metal back layer of the screen 10.

Therefore, each electron beam is accelerated in a high energy, thus colliding with the metal back layer. As a result, the fluorescent substance emits a light.

Supposing that a television screen is divided into a plurality of sections 11 of a matrix configuration and that one electron beam deflected according to the abovedescribed manner corresponds to each section 11, one electron beam scans and is deflected in each of the sections 11. Thus, all the sections 11 can be displayed on the screen 10. Video signals, corresponding to each pixel, of red, green, and blue are sequentially controlled by the voltage $V_3$ of the signal electrode 4 in the abovedescribed manner. Thus, a moving picture can be reproduced on the screen 10.

The improvement of the flow of an electron beam according to the embodiment is described below with reference to FIG. 1.

Figure 3:
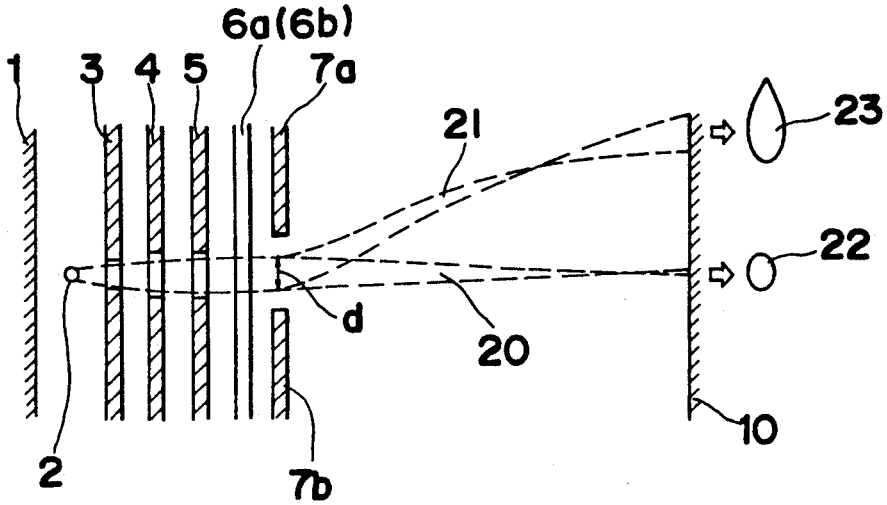
FIG. 3 is a vertical sectional view showing the trajectory of an electron beam radiated by the conventional image display apparatus.

Similarly to FIG. 3, FIG. 1 is a vertical sectional view showing the trajectory of one electron beam. The electron beam is electrostatically deflected by the potential difference between the vertical deflecting electrodes *7a* and *7b*, thus travelling along trajectories 34 and 35 and forming beam spots 36 and 37 on the screen 10. As a result, the fluorescent substance emits a light.

According to the embodiment, unlike the conventional trajectory of the electron beam shown in FIG. 3, electron beams cross over when they pass through the gap between the vertical deflecting electrodes *7a* and *7b* so that the diameter (d') of the electron beam can become minimum in the vertical section thereof. Electron beams can easily cross over there by adjusting the voltage in the abovedescribed manner utilizing the effect of the electron lens of the focusing electrode 5. Deflection errors of the beam spot can be eliminated by providing the voltage condition as described above. Deflection errors (coma) occur because voltages are different from each other according to points in the vertical sectional area of the electron beam when it passes through the gap between the vertical deflecting electrodes *7a* and *7b*. But the deflection errors can be prevented from occurring by focusing the electron beam so as to make the vertical sectional area thereof theoretically zero. Actually, the vertical sectional area of the electron beam has a finite value due to the deflection errors of the electron lens and the space-charge effect. But it is possible to focus the electron beam to such an extent that deflection errors are ignored.

Consequently, as shown by the beam spots 36 and 37, beam spots of approximately the same constant configuration and area can be formed on the screen 10 irrespective of a deflection amount.

Since the electron beams diverge after they cross over between the vertical deflecting electrodes *7a* and *7b*, beam spots may be formed on the screen 10 in an excessive large diameter and deteriorate an image quality. But the electron beam is accelerated in a high voltage toward the screen 10 after it passes through the gap between the vertical deflecting electrodes *7a* and *7b*. Accordingly, the electron beams can be prevented from diverging to such an extent as to deteriorate the image quality.

Thus, it is possible to improve the image quality.

According to the embodiment of the present invention, electron beams cross over in the vertical section thereof when they cross the vertical deflecting electrodes. Therefore, the amount of deflection errors caused by a coma can be greatly reduced and an image display apparatus capable of displaying a high quality image comprising beam spots each having a constant configuration can be manufactured.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for controlling electron beams in an image display apparatus, the image display apparatus including, in sequential order, a plurality of line cathodes arranged horizontally in parallel with each other, an electron beam lead electrode, a signal electrode, a focusing electrode, a horizontal deflecting electrode, a vertical deflecting electrode and a light emitting device, the vertical deflecting electrode including plural spaced apart conductive plate members extending horizontally in a same vertical plane, said method comprising the steps of:

radiating electron energy from at least one of the line cathodes towards the electron beam lead electrode and emitting plural electron beams from the electron beam electrodes towards the signal electrode;

selectively passing the electron beams through the signal electrode towards the focusing electrode in accordance with a video signal applied to the signal electrode;

electrostatically focusing the electron beams which have passed through the signal electrode by causing the focusing electrode to converge each electron beam to a focal point which is formed between two of said plural spaced apart conductive plate members, the thus focused electron beams being directed towards the horizontal deflecting electrode;

electrostatically deflecting the focused electron beams horizontally using the horizontal deflecting electrode, the thus horizontally deflected electron beams being directed towards the vertical deflecting electrode; and, electrostatically deflecting the horizontally deflected electron beams vertically using the vertical deflecting electrode, each thus vertically deflected electron beam being directed towards the light emitting device and forming an electron spot on the light emitting device, the light emitting device emitting light in response to each incident electron spot;

wherein a size of each electron spot is minimized by the convergence of each electron beam at the focal point which is formed between two of said plural spaced apart conductive plate members of the vertical deflecting electrode.

* * * * *